US012048359B2

(12) United States Patent
Camilli

(10) Patent No.: US 12,048,359 B2
(45) Date of Patent: Jul. 30, 2024

(54) CLASP FOR A BRACELET

(71) Applicant: BULGARI HORLOGERIE SA, Neuchatel (CH)

(72) Inventor: Alessandro Camilli, Le Landeron (CH)

(73) Assignee: BULGARI HORLOGERIE SA, Neuchatel (CH)

( * ) Notice: Subject to any disclaimer, the term of this patent is extended or adjusted under 35 U.S.C. 154(b) by 258 days.

(21) Appl. No.: 17/440,972

(22) PCT Filed: Mar. 17, 2020

(86) PCT No.: PCT/EP2020/057283
§ 371 (c)(1),
(2) Date: Sep. 20, 2021

(87) PCT Pub. No.: WO2020/187907
PCT Pub. Date: Sep. 24, 2020

(65) Prior Publication Data

US 2022/0160083 A1 May 26, 2022

(30) Foreign Application Priority Data

Mar. 21, 2019 (CH) ..... 372/2019

(51) Int. Cl.
*A44C 5/24* (2006.01)

(52) U.S. Cl.
CPC ..... *A44C 5/24* (2013.01)

(58) Field of Classification Search
CPC .... A44C 5/24; Y10T 24/2155; Y10T 24/4782
See application file for complete search history.

(56) References Cited

U.S. PATENT DOCUMENTS 2,532,840 A * 12/1950 Gaun ..... A44C 5/24 24/71 J
5,689,859 A * 11/1997 Cuche ..... A44C 5/24 24/69 J (Continued)

FOREIGN PATENT DOCUMENTS

CH 641 332 A5 2/1984
CH 689 931 A5 2/2000

(Continued)

OTHER PUBLICATIONS

International Search Report dated Jun. 15, 2020, issued in counterpart International Application No. PCT/EP2020/057283 (2 pages).

*Primary Examiner* — Robert Sandy
*Assistant Examiner* — Louis A Mercado
(74) *Attorney, Agent, or Firm* — WHDA, LLP

(57) ABSTRACT

A clasp (1) for a watchstrap or bracelet including a central blade (2) and two movable blades (12), each movable blade (12) being hinged at one longitudinal end of the central blade (2), characterised in that each movable blade (12) has two side arms (13) intended for being received outside the side surfaces of the central blade (2) in closed configuration, these two side arms (13) comprising a first free end connected by a first pin (10) to a longitudinal end of the central blade (2), and a second end capable of receiving a second pin (30) for connection with a strand (40) of the watchstrap or bracelet, the central blade (2) comprising a hollow portion (4) in the central upper surface thereof for receiving such a second pin (30) arranged at the second end of the side arms (13) in the closed configuration of the clasp (1).

20 Claims, 6 Drawing Sheets

(56) References Cited

U.S. PATENT DOCUMENTS

| | | | | |
|---|---|---|---|---|
| 6,401,307 | B1 * | 6/2002 | Wild | A44C 5/246 24/71 J |
| 8,789,246 | B2 * | 7/2014 | Yliluoma | A44C 5/246 24/71 J |
| 9,173,460 | B2 * | 11/2015 | Kaltenrieder | A44C 5/24 |
| 9,282,792 | B2 * | 3/2016 | Mace | A44C 5/24 |
| 9,486,042 | B2 * | 11/2016 | Isaacs | A44C 5/02 |
| D860,044 | S * | 9/2019 | Negaty | D11/217 |
| 10,463,141 | B2 * | 11/2019 | Fitzgerald | A45F 5/021 |
| 2014/0130545 | A1 * | 5/2014 | Leger | A44C 5/246 63/3.2 |
| 2014/0366339 | A1 * | 12/2014 | Haering | A44C 5/24 24/265 B |
| 2015/0351503 | A1 | 12/2015 | Isaacs et al. | |
| 2019/0380456 | A1 * | 12/2019 | Granito | A44C 5/246 |
| 2021/0393004 | A1 * | 12/2021 | Riotte | A44C 5/24 |

FOREIGN PATENT DOCUMENTS

| | | |
|---|---|---|
| EP | 0 620 986 A1 | 10/1994 |
| JP | 62-66505 U | 4/1987 |

* cited by examiner

CLASP FOR A BRACELET

The present invention relates to a clasp for a bracelet for a jewelry piece or timepiece. It also relates to a bracelet comprising such a clasp, and to a jewelry piece or timepiece comprising such a clasp.

Multiple solutions exist for attaching the two strands of a bracelet around the wrist of its wearer. The first solution is simple and consists in providing the ends of each strand with cooperation means, in the form for example of a simple buckle and a tongue on one end cooperating with holes on the other end. Such a solution has the drawback that, upon opening of the cooperation means, the two strands of the bracelet are immediately separated and present a risk that the bracelet falls off.

To overcome this drawback, another solution consists in providing an intermediate element of the clasp type, disposed between the two bracelet strands, which always remains secured to the ends of these two strands. Such a clasp assumes two configurations: a closed configuration, intended for when the bracelet is being worn, in which the bracelet and the clasp extend around the circumference of the wrist by having a total length allowing the bracelet to be held in place, and an open or deployed configuration, which makes it possible to increase the length of the clasp and therefore of the bracelet by separating the two ends of the two strands of the bracelet, without detaching them from the clasp, to allow the hand to pass through and the bracelet to be removed. In this open configuration of the clasp, the two strands of the bracelet are not separated, thereby minimizing the risk of the bracelet falling off, this being advantageous for example in the case of a wristwatch.

In the case of a solution having a clasp, a first objective is the pursuit of optimum comfort when the bracelet is being worn and a successful esthetic effect of the bracelet incorporating the clasp. To that end, it is advantageous for the clasp to best match the contour of a wrist, even a small wrist, when the clasp is in the closed configuration. In parallel, a second objective is to achieve a large open surface area of the bracelet in the deployed configuration of the clasp, in order to make it easier for a hand to pass through. One difficulty in producing a clasp therefore consists in defining the compromise between closely and comfortably fitting the wrist of a wristwatch wearer, achieving an esthetically appealing effect, and providing an opening which is large enough for the wearer's hand to pass through.

The present invention has the general object of providing a clasp for a bracelet that makes it possible to achieve an optimum esthetic effect, and maximum reliability and user-friendliness in terms of its opening and closing function.

To that end, the invention relates to a clasp for a bracelet which comprises a central blade and two movable blades, each movable blade being articulated at a longitudinal end of the central blade, wherein each movable blade has two lateral arms intended to become fitted on the outside of the lateral surfaces of the central blade in the closed configuration, these two lateral arms comprising a first free end which is connected by a first pin to a longitudinal end of the central blade, and a second end which is able to receive a second, connecting pin for connection to a bracelet strand, the central blade comprising a recessed portion in its central upper surface for the purpose of receiving such a second pin arranged at the second end of the lateral arms in the closed configuration of the clasp.

Each movable blade may comprise a U shape, with a transverse rod which connects the two arms at their second end, said transverse rod comprising a transverse opening which is able to receive a second, connecting pin for connection to a bracelet strand.

The lower surface of the central blade may be planar or have a convexity which is inverted in relation to its upper surface.

The clasp for a bracelet may comprise at least one securing device for securing each movable blade arranged in the central blade in order to hold the movable blades in place in the closed configuration of the clasp.

The securing device may be a ball/spring assembly or an elastic blade.

The central blade may comprise at least one transverse opening on either side of its recessed portion in order to receive in each of said transverse openings a securing device comprising two ball/spring assemblies.

The clasp for a bracelet may comprise a recessed zone and a stop which are arranged in the surface of at least one lateral arm for cooperation with a securing device in the closed configuration of the clasp.

The geometry of the lateral arms of the movable blades can be adapted to that of the central blade such that they protrude in the vertical direction neither from the upper surface nor from the lower surface of the central blade in the closed configuration of the clasp. The vertical direction is understood to mean perpendicularly to the lower and upper surfaces.

The invention also relates to a bracelet, wherein it comprises two bracelet strands connected by a clasp as described above.

The first links of each bracelet strand may comprise recessed zones in which at least part of the clasp becomes fitted in the closed configuration of the clasp.

The invention also relates to a jewelry piece or timepiece, wherein it comprises a bracelet as described above.

Other advantages and features will emerge more clearly from the following description of a particular embodiment of the invention, which is given by way of non-limiting example and shown in the accompanying drawings, in which.

Figure 1:
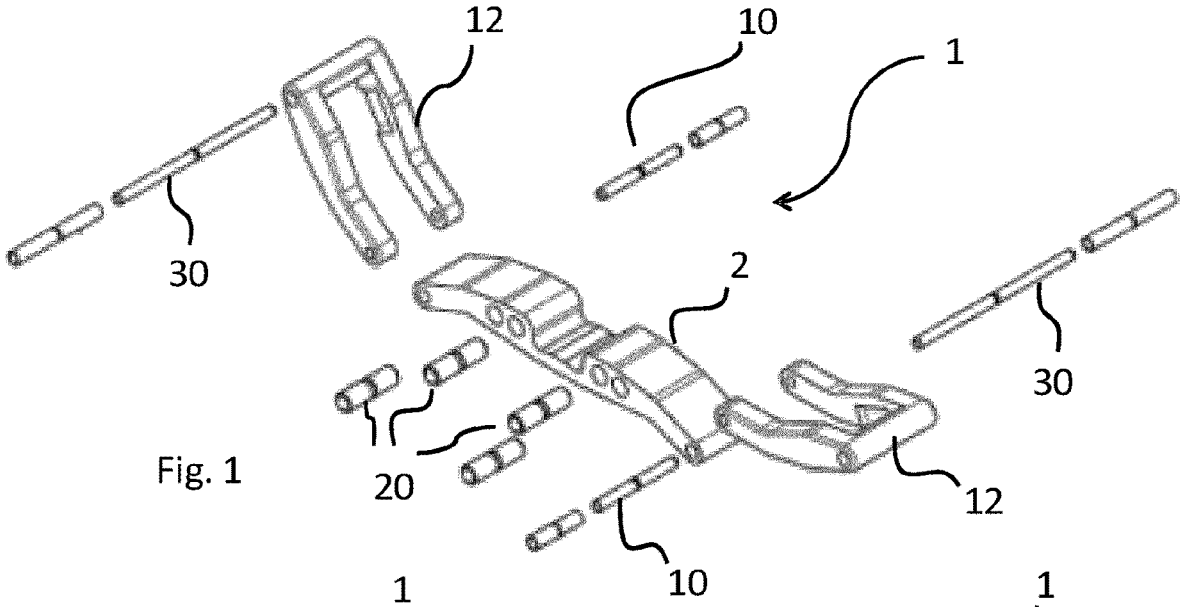
FIG. 1 shows an exploded perspective view from above of the clasp for a bracelet according to the embodiment of the invention.

In order to simplify the description, by convention, the term "longitudinal direction" will be used for the direction along the length of a clasp or a strand of a bracelet, and the term "transverse direction" will be used for the perpendicular direction, in the plane of a clasp or a strand of a bracelet (along its width). The vertical direction is the direction perpendicular to the first two directions, and is oriented perpendicularly to the plane of the bracelet or of the clasp. In addition, the term "link" will be used for an individual component of a bracelet. "Bracelet" denotes either the bracelet as a whole, with or without the clasp, or one or the other of the strands of the bracelet. The adjectives "upper" and "lower" are used to denote a surface or an element positioned on the side opposite the wrist and on the side of the wrist, respectively, considering the situation in which the clasp and the bracelet are positioned around a wrist, or by extension such that they are configured to come around a wrist. The adjective "lateral" will be used to denote a surface or an element positioned toward the ends of the clasp and of the bracelet as viewed in a transverse direction. The lateral ends of the clasp will be advantageously formed by longitudinal vertical flanks.

FIGS. 1 to 5 illustrate a clasp 1 according to one embodiment of the invention. Such a clasp comprises three blades, a central blade 2 enclosed by two movable blades 12, which are arranged symmetrically via a connection which can be moved in rotation about a first pin 10 which is arranged at each longitudinal end of the central blade 2. Each movable blade 12 comprises a second pin 30 which is arranged at its longitudinal end situated opposite that which is linked to the central blade 2, via which said movable blade is able to be linked to a bracelet strand, as will be described below in relation to FIGS. 12 to 15.

Figure 2:
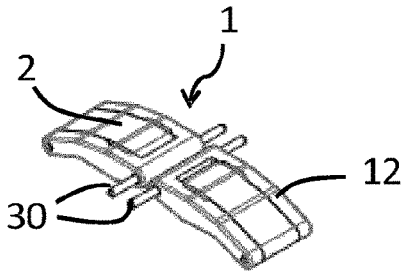
FIG. 2 shows a perspective view from above of the clasp in the closed configuration according to the embodiment of the invention.
Figure 3:
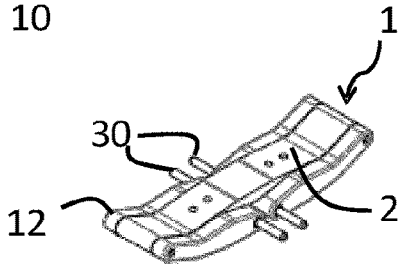
FIG. 3 shows a perspective view from below of the clasp in the closed configuration according to the embodiment of the invention.
Figure 4:
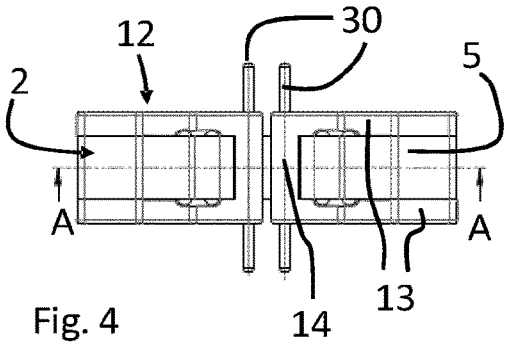
FIG. 4 shows a view from above of the clasp in the closed configuration according to the embodiment of the invention.

FIGS. 2 to 4 show the clasp in the closed configuration, in which each movable blade 12 is bent over the central blade 2. In this closed configuration, the ends of each movable blade 12 that are intended for receiving the securing means of a bracelet strand come close to one another, in contact or almost in contact, in the central part of the central blade 2. A securing device 20 holds this closed configuration of the clasp in place in a stable manner, which will be set out below.

Figure 7:
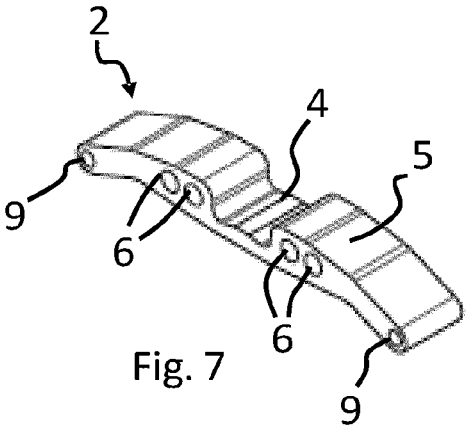
FIG. 7 shows a perspective view from above of the central blade of the clasp according to the embodiment of the invention.
Figure 8:
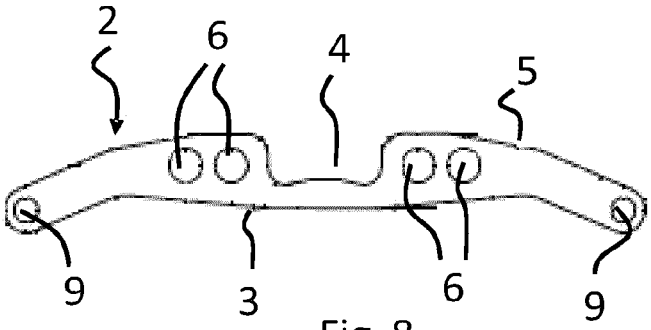
FIG. 8 shows a side view of the central blade of the clasp according to the embodiment of the invention.

FIGS. 7 and 8 show more specifically the central blade 2 of the clasp 1 according to the embodiment of the invention. This central blade 2 is narrow in the transverse direction since it is intended to be covered laterally by the arms of the movable blades 12, as will be specified below. This width in the transverse direction constitutes substantially half of the total width of the clasp. A recessed portion 4 is arranged in the central part of the upper surface 5 of the central blade 2 and is intended to receive transverse rods 14 of the movable blades 12, as is particularly visible in FIG. 5. Apart from this recessed portion 4, the upper surface has a rounded, convex shape which substantially follows the shape of a wrist. By contrast to this, the lower surface 3 of the central blade 2, which is intended to come into direct contact with a wrist, has a substantially planar central part, or even, surprisingly, a convexity which is slightly inverted in relation to the wrist. This shape makes it possible to maximize the height (that is to say the thickness) of the central blade 2 in its central part, the height being measured in the vertical direction, so as to be able to form a recessed portion 4 which is large enough to receive the transverse rods 14. Thus, the convexities of the two surfaces, the upper surface 5 and lower surface 3, are adapted to increase the height of the central blade in its center. This increase is also adapted to the material chosen for the central blade, since it also makes it possible to achieve a shape with sufficient mechanical strength. Arranged around this central recessed portion 4 are transverse through-openings 6, in a zone of the central blade 2 which is high enough to advantageously receive securing devices 20 for securing the movable blades, which will be specified below. More precisely, two transverse openings 6 are arranged on either side of the recessed portion 4. Finally, a transverse opening 9 is arranged at each longitudinal end of the central blade 2, and is designed to receive a first pin 10 for the pivoting of a movable blade 12.

Figure 9:
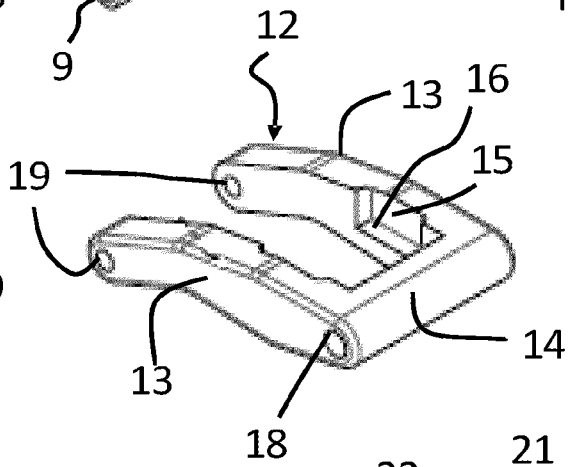
FIG. 9 shows a perspective view from above of a movable blade of the clasp according to the embodiment of the invention.

FIG. 9 shows a movable blade 12 of the clasp according to the embodiment of the invention. Such a movable blade has a U shape, comprising two lateral arms 13 intended to become fitted on the outside of the lateral surfaces of the central blade 2 in the closed configuration, as shown in FIGS. 2 to 4. The two lateral arms 13 comprise a first, connected free end, provided with an opening 19 which is intended to receive the first pivoting-connection pin 10 for pivoting connection to one end of the central blade 2. The movable blade 12 moreover comprises a transverse rod 14, forming the base of the U shape, which connects the two lateral arms 13 at their second end. This transverse rod 14 comprises a transverse through-opening 18 which is intended to receive the second, connecting pin 30 for connection to a bracelet strand. Finally, each arm 13 comprises in its inner surface a recessed zone 15, which is intended to cooperate with a securing device, which will be described below.

Figure 5:
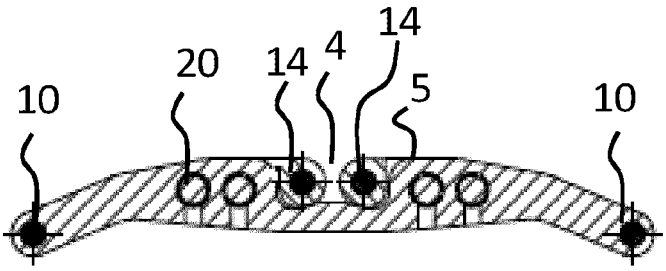
FIG. 5 shows a side view in longitudinal section of the clasp in the closed configuration according to the embodiment of the invention.

In the closed configuration of the clasp, the two transverse rods 14 of the two movable blades 12, respectively, come to be fitted in the recessed portion 4 of the central blade 2, and the lateral arms 13 of each movable blade are positioned around the central blade, against the right and left lateral surfaces of the central blade, almost in contact. The movable blades and the central blade are thus positioned substantially in the same horizontal plane. As shown in the section of FIG. 5, through a median longitudinal sectional plane AA shown in FIG. 4, the shape of the recessed portion 4 is adapted to the transverse rods 14, such that these rods are entirely placed in these recessed portions, in particular do not protrude or protrude only slightly from the upper surface 5 of the central blade 2. The recessed portion 4 comprises a convex, rounded base which has a higher surface in the central part, thus forming two recesses delimited substantially by walls in the shape of portions of a circle, with a radius of curvature adapted to the cylindrical transverse rods 14. Additionally, the lateral arms 13 have a height and a shape corresponding to the central blade 2, such that these lateral arms 13 do not protrude from the central blade 2 in the vertical direction in the closed configuration of the clasp. This arrangement minimizes the bulk of the clasp in the closed configuration in order to minimize its impact on a bracelet as a whole, as will be illustrated below.

Figure 10:
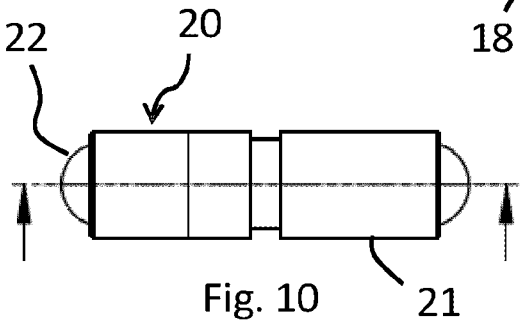
FIG. 10 shows a securing device for securing the clasp according to the embodiment of the invention.
Figure 11:
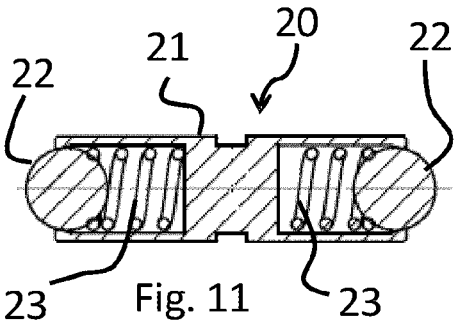
FIG. 11 shows a sectional view of the securing device for securing the clasp according to the embodiment of the invention.

In addition, the clasp 1 is equipped with several securing devices 20, shown in FIGS. 10 and 11, the function of which is to participate in holding the movable blades 12 in place in the closed configuration of the clasp, in order to prevent the unintended accidental opening of the clasp. Each securing device 20 comprises a substantially cylindrical body 21, comprising on each open end a ball 22 which is subject to the load of a helical spring 23, in the preloaded configuration. At rest, as shown in FIGS. 10 and 11, each helical spring 23 exerts a force on the associated ball 22, said force being oriented toward the outside of the securing device 20. Each ball 22 is thus held in abutment against an inner lateral wall of the securing device while protruding from this device at its two ends. A securing device 20 is configured to be positioned in a transverse opening 6 of the central blade 2, such that each of the two balls 22 protrudes on the outside of the lateral walls on the left and right, respectively, of the central blade.

Figure 6:
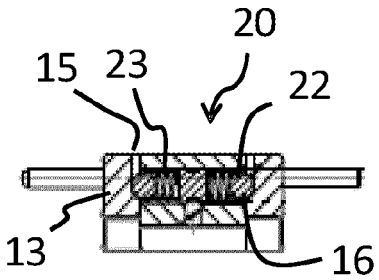
FIG. 6 shows a side view in cross section of the clasp in the closed configuration according to the embodiment of the invention.

During an operation of closing the clasp, the arms 13 of the movable blades 12 come to bear against the protruding balls 22, causing them to temporarily retract inside the securing device 20 counter to the forces exerted by the associated springs 23. When said arms 13 continue their movement as far as their final, closed position, the balls 22 are positioned next to the recessed zones 15 arranged in the inner surface of these arms 13, this allowing the balls 22 to resume their protruding rest position, under the effect of their associated springs. The balls 22 thus come to be fitted in the recessed zones 15 of the arms 13 of the movable blades 12. Each recessed zone 15 comprises a horizontal, or even chamfered, surface which delimits it, said horizontal surface being positioned in the lower part in the closed configuration of the clasp, which thus forms a stop 16 by coming to bear against the balls 22, as shown in FIG. 6, preventing the opening movement of the movable blades 12 upwardly and thus ensuring the function of holding in place. This arrangement, in particular the force exerted by the springs 23, is designed to prevent the unintended opening of the clasp 1, while allowing it to be opened by a deliberate effort from a user.

Figure 12:
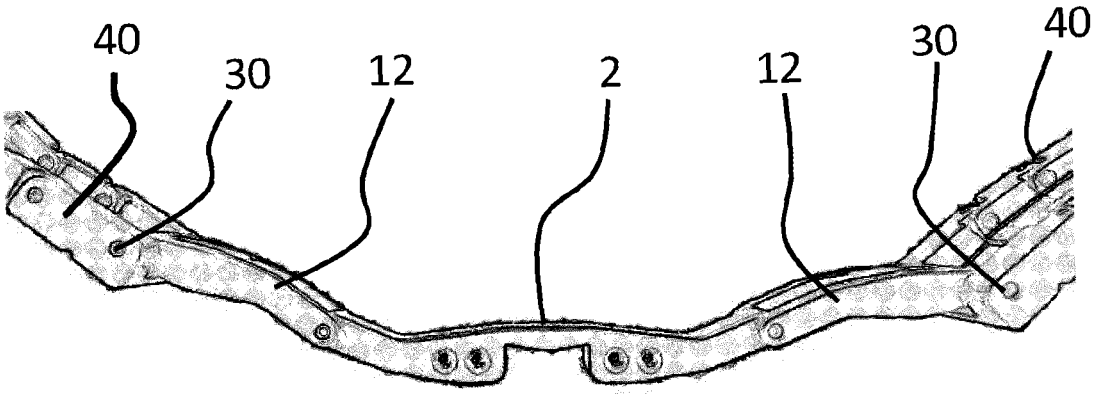
FIG. 12 shows a side view of a bracelet equipped with a clasp in the open configuration according to the embodiment of the invention.

FIG. 12 illustrates the clasp joined to two bracelet strands 40 via the second pins 30 of the two movable blades 12, as mentioned above. The clasp is in its deployed configuration, having a total length which corresponds to the sum of the length of the central blade 2 and the lengths of the two movable blades 12, this greatly increasing the total length of the bracelet in order for a hand to pass through.

Figure 13:
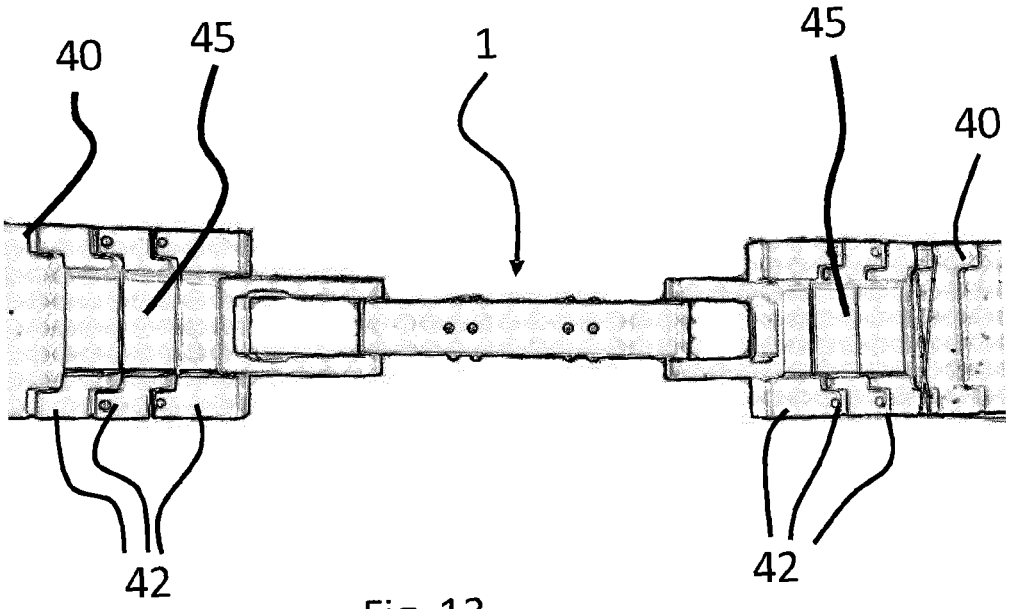
FIG. 13 shows a view from below of the bracelet equipped with a clasp in the open configuration according to the embodiment of the invention.

FIG. 13 illustrates the same bracelet with its clasp in the open position, in a view from below. This illustrates that the first links 42 of each bracelet strand, close to a movable blade, have a recessed zone 45 in their lower surfaces that has a geometry allowing half of the clasp to become at least partially fitted in the closed configuration, in order to hide it and minimize its esthetic impact in the closed configuration of the clasp.

Figure 14:
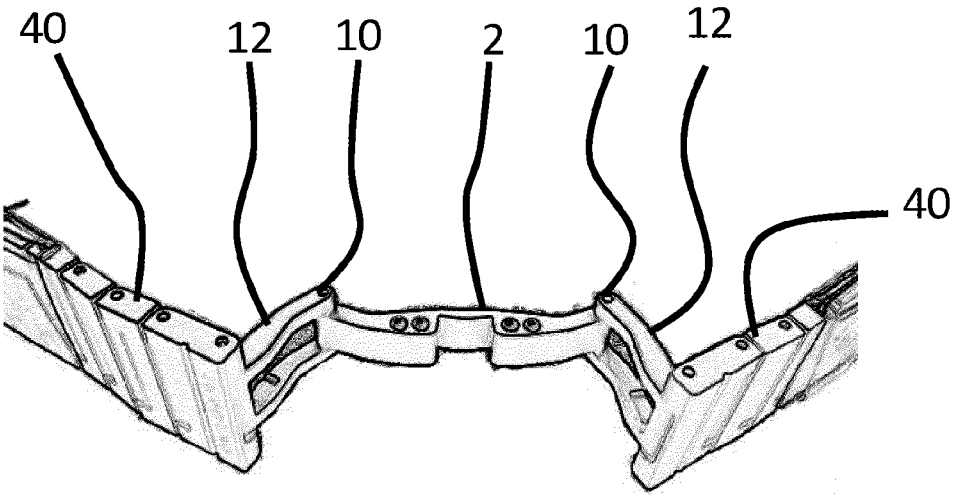
FIG. 14 shows a perspective side view of the bracelet equipped with a clasp during the closing phase according to the embodiment of the invention.
Figure 15:
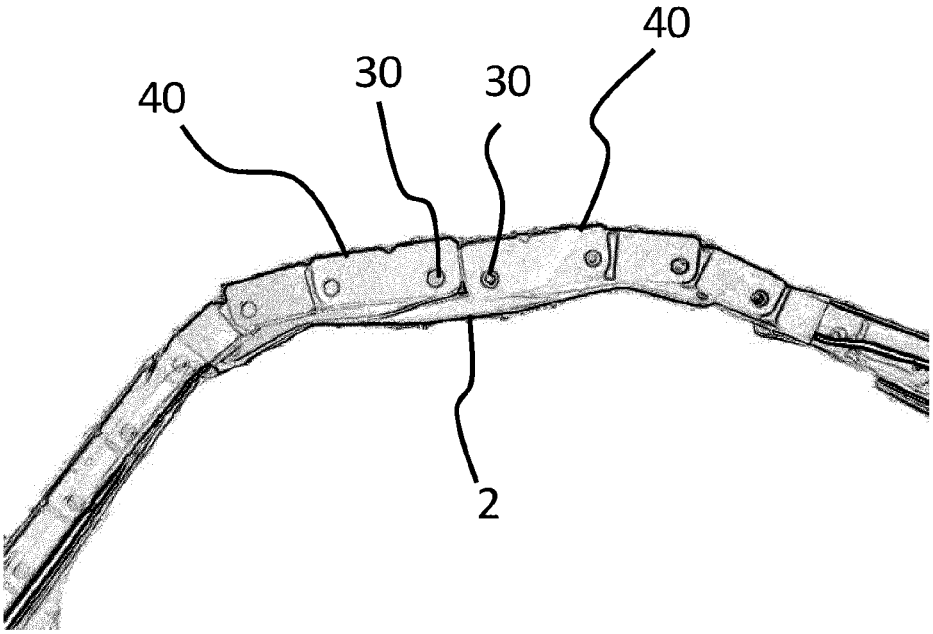
FIG. 15 shows a side view of the bracelet equipped with a clasp in the closed configuration according to the embodiment of the invention.
Figure 16:
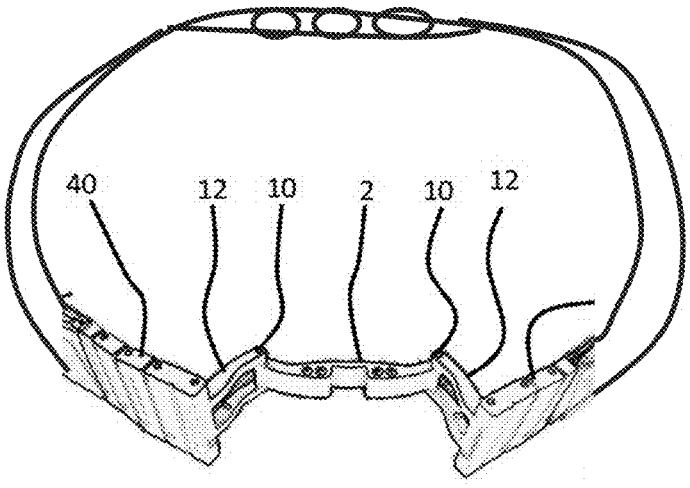
FIG. 16 shows a perspective side view of a jewelry piece including the bracelet equipped with a clasp during the closing phase according to an embodiment of the invention.
Figure 17:
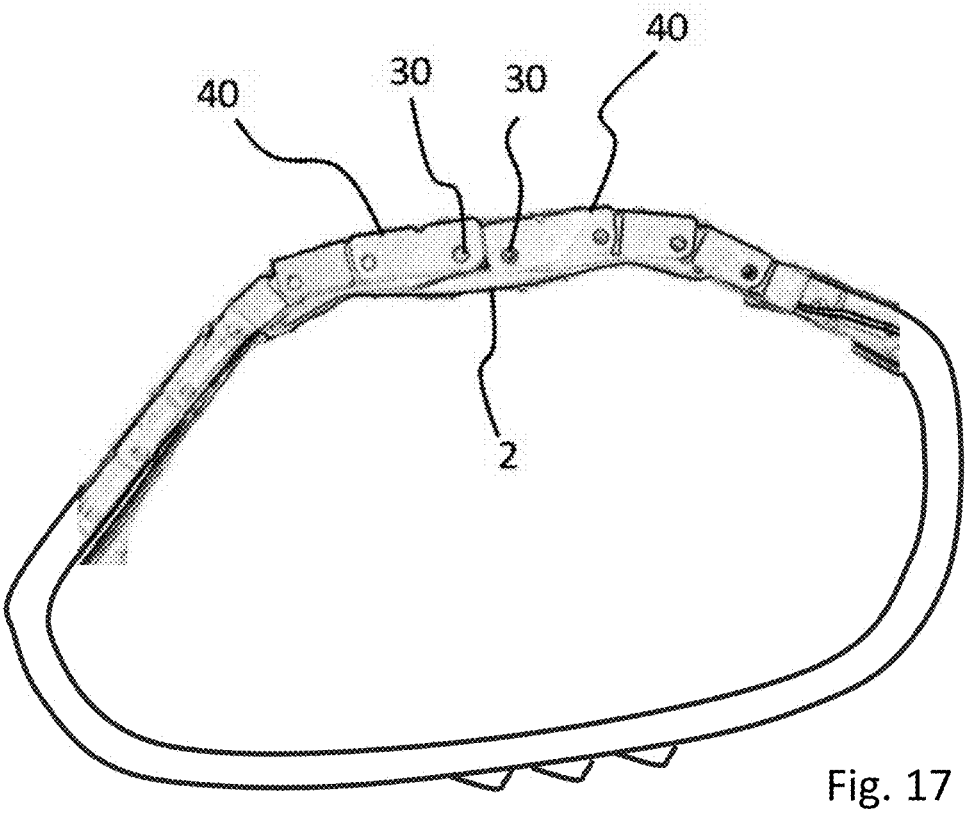
FIG. 17 shows a side view of the jewelry piece including the bracelet equipped with a clasp in the closed configuration according to an embodiment of the invention.
Figure 18:
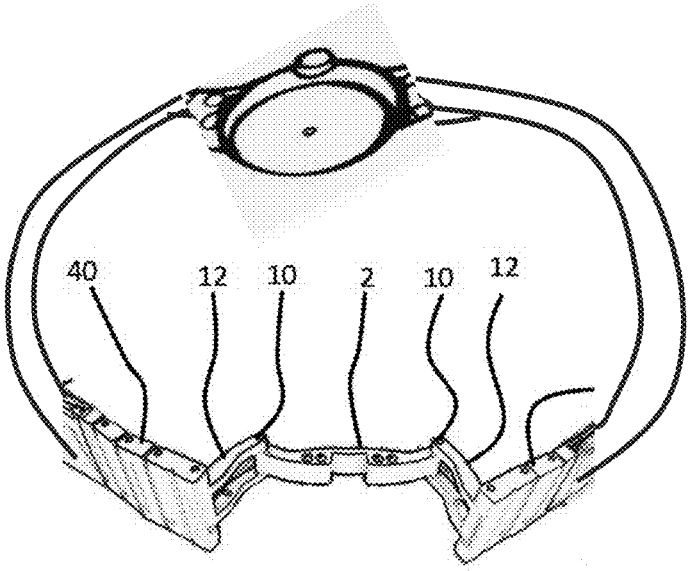
FIG. 18 shows a perspective side view of a timepiece including the bracelet equipped with a clasp during the closing phase according to an embodiment of the invention.
Figure 19:
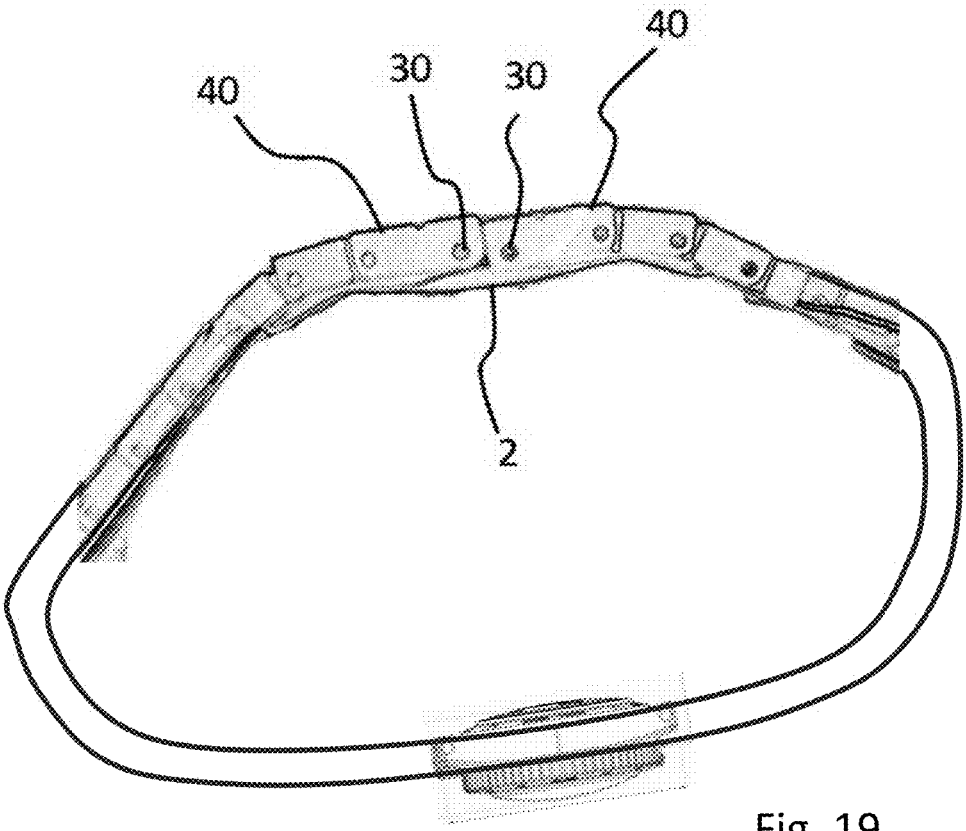
FIG. 19 shows a side view of the timepiece including the bracelet equipped with a clasp in the closed configuration according to an embodiment of the invention.

FIG. 14 illustrates an intermediate phase of closing the clasp of the bracelet shown in FIGS. 12 and 13. For this, the two blades are pivoted about their respective first pin 10, until the closed configuration shown in FIG. 15 is reached. In this closed position, the two transverse rods 14 and therefore the second pins 30 are inserted into the recessed portion of the central blade 2 of the clasp, this bringing the upper surface of each end of the bracelet strand 40 almost into contact, forming in the view from above an impression of a continuous bracelet, the clasp not being visible. This impression is reinforced by the fact that the clasp is then fitted entirely or in part in the recessed zones 45 of the first links 42 of the bracelet strands. In this way, even in the side view of FIG. 15, the clasp 1 is nearly invisible in the closed configuration. This construction thus has the advantage of obtaining optimum esthetics, since the clasp is hidden in the closed configuration, the bracelet appearing to be continuous.

It should be noted that the links of the bracelet thus have a width which is greater than that of the clasp. This width may be greater than or equal to 30%, even 50%, or even twice the width of the clasp.

The various blades of the clasp may be made of a metal or a metal alloy, such as titanium, or of ceramic. As a variant, they may be made of a plastics material, such as PEEK, or of a composite material, such as a carbon-based composite.

As mentioned above, the invention also relates to a piece, which may be a bracelet. It thus also relates to a timepiece, such as a wristwatch, which may comprise such a bracelet. More generally, it also relates to a jewelry piece or timepiece which comprises such a bracelet.

It goes without saying that the invention is not limited to the embodiment described. In particular, the securing device 20 could be different. The number of balls in the ball/spring assemblies could be different. As a variant, the securing device could be formed by a means other than a ball/spring assembly, for example by another device comprising an elastically movable securing element. This securing element may be formed by a lateral elastic blade obtained directly by a cut made in the material of the central blade of the clasp.

The shape of the elements of the clasp could be different. In particular, the movable blades always comprise two lateral arms which come against the lateral faces of the central blade. However, they do not necessarily have a U shape, it being possible for the second, connecting pin 30 to replace the transverse rod 14.

The invention also relates to a clasp for a bracelet which comprises a central blade and two movable blades, each movable blade being articulated at a longitudinal end of the central blade, wherein the central blade comprises at least one transverse opening for the purpose of receiving a securing device for holding the movable blades in place in the closed configuration of the clasp. This securing device may comprise two ball/spring assemblies.

The invention claimed is:

1. A clasp for a bracelet which comprises a central blade and two movable blades, each of the movable blades being articulated at a longitudinal end of the central blade, wherein each of the movable blades has two lateral arms intended to become fitted on an outside of lateral surfaces of the central blade in a closed configuration, the two lateral arms comprising a first free end which is connected by a first pin to the longitudinal end of the central blade, and a second end which is able to receive a second pin for connection to a bracelet strand, the central blade comprising a recessed portion in an upper surface for a purpose of receiving the second pin arranged at the second end of the lateral arms of each of the movable blades in the closed configuration of the clasp.

2. The clasp for the bracelet as claimed in claim 1, wherein each of the movable blades comprises a U shape, with a transverse rod which connects the two arms at the second end, said transverse rod comprising a transverse opening which is able to receive the second pin for connection to the bracelet strand.

3. The clasp for the bracelet as claimed in claim 2, wherein a lower surface of the central blade is planar or has a convexity which is inverted in relation to the upper surface.

4. The clasp for the bracelet as claimed in claim 2, wherein it comprises at least one securing device for securing each of the movable blades arranged in the central blade in order to hold the movable blades in place in the closed configuration of the clasp.

5. The clasp for the bracelet as claimed in claim 1, wherein a lower surface of the central blade is planar or has a convexity which is inverted in relation to the upper surface.

6. The clasp for the bracelet as claimed in claim 5, wherein it comprises at least one securing device for securing each of the movable blades arranged in the central blade in order to hold the movable blades in place in the closed configuration of the clasp.

7. The clasp for the bracelet as claimed in claim 1, wherein it comprises at least one securing device for securing each of the movable blades arranged in the central blade in order to hold the movable blades in place in the closed configuration of the clasp.

8. The clasp for the bracelet as claimed in claim 7, wherein the securing device is a ball/spring assembly or an elastic blade.

9. The clasp for the bracelet as claimed in claim 8, wherein the central blade comprises at least one transverse opening on either side of the recessed portion in order to receive in each of said transverse openings the securing device comprising two ball/spring assemblies.

10. The clasp for the bracelet as claimed in claim 9, wherein it comprises a recessed zone and a stop which are arranged in a surface of at least one of the lateral arms for cooperation with the securing device in the closed configuration of the clasp.

11. The clasp for the bracelet as claimed in claim 8, wherein it comprises a recessed zone and a stop which are arranged in a surface of at least one of the lateral arms for cooperation with the securing device in the closed configuration of the clasp.

12. The clasp for the bracelet as claimed in claim 7, wherein it comprises a recessed zone and a stop which are arranged in a surface of at least one of the lateral arms for cooperation with the securing device in the closed configuration of the clasp.

13. The clasp for the bracelet as claimed in claim 1, wherein a geometry of the lateral arms of the movable blades is adapted to that of the central blade such that they protrude in a vertical direction neither from the upper surface nor from a lower surface of the central blade in the closed configuration of the clasp.

14. A bracelet, wherein it comprises two bracelet strands connected by the clasp as claimed in claim 1.

15. The bracelet as claimed in claim 14, wherein first links of each of the bracelet strands comprise recessed zones in which at least part of the clasp becomes fitted in the closed configuration of the clasp.

16. A jewelry piece or timepiece, wherein it comprises the bracelet as claimed in claim 15.

17. A jewelry piece or timepiece, wherein it comprises the bracelet as claimed in claim 14.

18. A clasp for a bracelet which comprises a central blade and two movable blades, each of the movable blades being articulated at a longitudinal end of the central blade, wherein each of the movable blades has two lateral arms intended to become fitted on an outside of lateral surfaces of the central blade in a closed configuration, the two lateral arms comprising a first free end which is connected by a first pin to the longitudinal end of the central blade, and a second end which is able to receive a second pin for connection to a bracelet strand, the central blade comprising a recessed portion in an upper surface for a purpose of receiving the second pin arranged at the second end of the lateral arms in the closed configuration of the clasp, wherein each of the movable blades comprises a U shape, with a transverse rod which connects the two arms at the second end, said transverse rod comprising a transverse opening which is able to receive the second pin for connection to the bracelet strand.

19. A clasp for a bracelet which comprises a central blade and two movable blades, each of the movable blades being articulated at a longitudinal end of the central blade, wherein each of the movable blades has two lateral arms intended to become fitted on an outside of lateral surfaces of the central blade in a closed configuration, the two lateral arms comprising a first free end which is connected by a first pin to the longitudinal end of the central blade, and a second end which is able to receive a second pin for connection to a bracelet strand, the central blade comprising a recessed portion in an upper surface for a purpose of receiving the second pin arranged at the second end of the lateral arms in the closed configuration of the clasp, wherein it comprises at least one securing device for securing each of the movable blades arranged in the central blade in order to hold the movable blades in place in the closed configuration of the clasp, wherein the securing device is a ball/spring assembly or an elastic blade.

20. A clasp for a bracelet which comprises a central blade and two movable blades, each of the movable blades being articulated at a longitudinal end of the central blade, wherein each of the movable blades has two lateral arms intended to become fitted on an outside of lateral surfaces of the central blade in a closed configuration, the two lateral arms comprising a first free end which is connected by a first pin to the longitudinal end of the central blade, and a second end which is able to receive a second pin for connection to a bracelet strand, the central blade comprising a recessed portion in an upper surface for a purpose of receiving the second pin arranged at the second end of the lateral arms in the closed configuration of the clasp, wherein it comprises at least one securing device for securing each of the movable blades arranged in the central blade in order to hold the movable blades in place in the closed configuration of the clasp, wherein it comprises a recessed zone and a stop which are arranged in a surface of at least one lateral arm for cooperation with the securing device in the closed configuration of the clasp.

* * * * *